US009802682B2

(12) United States Patent
Huang et al.

(10) Patent No.: US 9,802,682 B2
(45) **Date of Patent: *Oct. 31, 2017**

(54) BUTT JOINT OCTAGONAL FRUSTUM TYPE FLOATING PRODUCTION STORAGE AND OFFLOADING SYSTEM

(71) Applicant: DALIAN UNIVERSITY OF TECHNOLOGY, Dalian, Liaoning (CN)

(72) Inventors: Yi Huang, Liaoning (CN); Wenhua Wang, Liaoning (CN); Yuxin Yao, Liaoning (CN); Gang Liu, Liaoning (CN); Qi Zhang, Liaoning (CN); Hongxia Li, Liaoning (CN); Jingjie Chen, Liaoning (CN); Gangjun Zhai, Liaoning (CN)

(73) Assignee: DALIAN UNIVERSITY OF TECHNOLOGY, Dalian, Liaoning (CN)

( * ) Notice: Subject to any disclaimer, the term of this patent is extended or adjusted under 35 U.S.C. 154(b) by 20 days.

This patent is subject to a terminal disclaimer.

(21) Appl. No.: 14/416,464

(22) PCT Filed: May 3, 2013

(86) PCT No.: PCT/CN2013/075138
§ 371 (c)(1),
(2) Date: Jan. 22, 2015

(87) PCT Pub. No.: WO2014/059785
PCT Pub. Date: Apr. 24, 2014

(65) Prior Publication Data

US 2015/0175245 A1 Jun. 25, 2015

(30) Foreign Application Priority Data

Oct. 15, 2012 (CN) ..... 2012 1 0390348
Oct. 15, 2012 (CN) ..... 2012 2 0526306 U

(51) Int. Cl.
*B63B 35/44* (2006.01)
*B63B 1/04* (2006.01)
(Continued)

(52) U.S. Cl.
CPC ..... *B63B 35/4413* (2013.01); *B63B 1/04* (2013.01); *B63B 1/041* (2013.01); *B63B 3/20* (2013.01);
(Continued)

(58) Field of Classification Search
CPC ..... B63B 35/4413; B63B 3/20; B63B 35/08; B63B 2003/147
(Continued)

(56) References Cited

U.S. PATENT DOCUMENTS

2009/0126616 A1* 5/2009 Srinivasan ..... B63B 35/44 114/264
2011/0107951 A1* 5/2011 Vandenworm ..... B63B 1/041 114/125

FOREIGN PATENT DOCUMENTS

CN 202863728 U 4/2013
NL WO 2012005587 A1 * 1/2012 ..... B63B 35/4413
WO 20071117300 A2 10/2007

OTHER PUBLICATIONS

Bin Qi, Recent Development Situation World FPSO Ship Type, China Ship Survey, Jan. 11, 2010, No. 11 pp. 32-34.

* cited by examiner

*Primary Examiner* — Anthony Wiest
(74) *Attorney, Agent, or Firm* — Nocik, Kim & Lee, PLLC; Allen Xue

(57) ABSTRACT

A butt joint octagonal frustum type floating production storage and offloading (FPSO) system, wherein a floating body is provided with an upper structural body in an octagonal frustum shape and a lower structural body in a
(Continued)

regular octagonal frustum shape; in a combined state, a smaller bottom surface of the upper structural body is fixedly connected with a smaller bottom surface of the lower structural body, to form a junction surface; the axis of the upper structural body and the axis of the lower structural body are positioned on the same straight line; the larger bottom of the upper structural body acts as an upper deck of the floating structure and the larger bottom of the lower structural body acts as a lower plate underwater of the floating structure; the junction surface is a full-load waterplane of the floating structure.

7 Claims, 6 Drawing Sheets

(51) Int. Cl.
*B63B 3/20* (2006.01)
*B63B 21/50* (2006.01)
*B63B 29/02* (2006.01)
*B63B 35/50* (2006.01)

(52) U.S. Cl.
CPC ..... *B63B 21/50* (2013.01); *B63B 29/02* (2013.01); *B63B 35/50* (2013.01)

(58) Field of Classification Search
USPC ..... 114/256, 264
See application file for complete search history.

BUTT JOINT OCTAGONAL FRUSTUM TYPE FLOATING PRODUCTION STORAGE AND OFFLOADING SYSTEM

TECHNICAL FIELD

The present invention relates to a ship (patent classification No: B63) or other waterborne vessels; a ship having ship-related equipment B63B and other waterborne vessels; and shipborne equipment B63B35/00 suitable for ships for special purposes or similar floating buildings having a floating structure B63B35/44, waterborne cabins, waterborne drilling platforms or waterborne workshops, for instance, which are loaded with oil-water separation equipment.

BACKGROUND ART

In the oceaneering field, a floating production storage and offloading system (FPSO for short) is an offshore oil and gas processing system integrating oil and gas processing, oil storage and offloading, heat supply, power generation, control and life functions, which has gradually become a mainstream mode for offshore oilfield development in the world owning to the advantages of strong oil storage capability, wide applicability and the like.

Generally, the FPSO system mainly comprises floating main body, mooring and positioning system, oil storage and transport module, oil and gas processing module, living support module and other multiple modules, which are essential facilities for technology-intensive and capital-intensive offshore oil development. Wherein, the kinetic characteristic, structural strength, oil storage efficiency, construction cost, operation cost, safety and other properties of the FPSO system depend on the appearance of the floating body.

The traditional FPSO systems are generally transformed from old oil tankers or are barge-like FPSO systems designed and built in accordance with standard shipping ideas. However, those ship-like floating bodies have some limitations and shortages in the appearance as follows:

1. The natural heave period of the traditional ship-like FPSO is hardly away from a wave energy concentration area, and the heave movement amplitude is relatively large. Besides, the ship-like FPSO is very sensitive to the action direction of waves and has overlarge area of transverse motion in heading sea, thus resulting in relatively poor sway movement performances, all of which will seriously affect normal work of various equipments and instruments of FPSO as well as quality of produced raw oil and comfortable level of staff.

2. The traditional ship-like FPSO has a 360-degree all-sided freely-rotating wind indicator effect due to a single-point mooring system equipped with an inner turret and a fluid connector, however, serious yaw movement will not only affect normal running of many works, but will wear the inner turret and the fluid connector to make them frequent in need of repair and maintenance. Therefore, the production cost will be greatly increased due to self exorbitant prices of the inner turret and the fluid connector and existence of potential downtime.

3. The traditional ship-like FPSO has relatively large longitudinal size and very large corresponding longitudinal hogging and sagging bending loads, which makes the floating body easily suffer bending and fatigue rupture. Particularly for FPSO transformed from old ships, the fatigue phenomenon is especially serious. Therefore, in order to meet the requirements on strength and fatigue load, load reinforcement needs to be performed generally, and accordingly, the construction cost of FPSO is increased.

4. The length and the layout difficulty of a connecting piping system among numerous functional modules will be increased by the slender floating body and the deck of the traditional ship-like FPSO, and accordingly, the construction cost and the maintenance cost are increased potentially.

Moreover, the cylindrical FPSO main body is of a floating cylindrical structure moored at the bottom of the sea. Such structure has large-scale storage, oil and gas production capabilities, is not sensitive to the directivity of wind, wave and current and has relatively small yaw movement amplitude, and whereas it has many shortages in terms of performances: large heave movement amplitude of the floating body, vortex-induced vibration, and the living space is too close to the working space by reason of relatively small deck area, which is not advantageous to separating a danger area from a non-danger area.

SUMMARY OF THE PRESENT INVENTION

The present invention has been devised to solve such technical problems, and an object thereof is to provide a butt joint octagonal frustum type floating production storage and offloading system, wherein a floating body is provided with an upper structural body in a regular octagonal frustum shape and a lower structural body in a regular octagonal frustum shape; under a combined state, the bottom surface having a relatively small area of the upper structural body is fixedly connected with the bottom surface having a relatively small area of the lower structural body to form a junction surface; the axis of the upper structural body and the axis of the lower structural body are positioned on the same straight line, the bottom having a relatively large area of the upper structural body acts as an upper deck of the floating structure and the bottom having a relatively large area of the lower structural body acts as a lower bottom underwater of said floating structure; the junction surface acts as the waterplane of the floating structure.

An annular side plate configured to increase pitch/roll and heave damping of the floating body is connected to the outer surface of said lower structural body.

The upper structural body internally has a center compartment I which is identical in height with said upper structural body, and multiple watertight compartments surrounding the center compartment I are arranged around the center compartment I and are fixedly connected with the inner wall of a hull of the upper structural body and the outer wall of the center compartment I, respectively; and The lower structural body internally has a center compartment II which is identical in height with said lower structural body, and multiple watertight compartments surrounding the center compartment II are arranged around the center compartment II and are fixedly connected with the inner wall of a hull of the lower structural body and the outer wall of the center compartment II, respectively.

The center compartment I and the center compartment II, which intercommunicate with each other, define a moonpool which is communicated with seawater and supports flexible, tower-type and steel catenary risers.

Multiple support pillars are arranged outside the structure main body, wherein two ends of each support pillar are fixedly connected with the upper structural body and the lower structural body, respectively; and each support pillar and the axis of the structure are located on the same plane.

The multiple support pillars are uniform in length, wherein the fixed ends, positioned on the upper structural body, of the multiple support pillars are located on the same plane, and the fixed ends, positioned on the lower structural body, of the rest multiple support pillars are located on the same plane; the adjacent two support pillars constitute an isosceles triangle.

The floating structure is of a double-hull structure.

A production module and a life module, which are independent of each other, are arranged on the deck, wherein the life module is positioned on one side of the deck and comprises a life and office building and a helicopter deck positioned above the life and office building; the production module comprises a main generator module and a heat station module which are close to the life module and positioned in the middle of the deck; a water treatment module and an oil and gas processing module are arranged on the other side of the deck; a flare tower is arranged between the water treatment module and the oil and gas treatment module; a crane is arranged beside the life module.

The watertight compartments comprise inner compartments which are connected with the center compartments and serve as oil storage compartments and multifunctional outer compartments which are connected with the inner compartments and the structure hull;

A multi-point mooring system is equipped around the floating body and configured for FPSO to moor and locate under various sea conditions.

A mooring rope and an external transport hose which are arranged on one side of the floating body are configured to connect a shuttle tanker for raw oil transportation.

Due to the adoption of the technical scheme, the butt joint octagonal frustum type FPSO system provided by the present invention is implemented by virtue of a simple structure; and the butt joint octagonal frustum type FPSO system has a relatively large oil storage space compared with the traditional drilling and production platform and better movement performance compared with the traditional oil storage ship-like FPSO. Therefore, the new type FPSO system provided by the present invention is beneficial to realizing integration of multiple functions, such as drilling, mining, storage, production, processing and transportation of large-scale oil and gas in various sea areas and thus has better economic benefit.

BRIEF DESCRIPTION OF THE DRAWINGS

Accompanying drawings that need to be used in description of the embodiments or the existing technology will be briefly introduced below in order to illustrate the embodiments of the present invention and the technical solution of the existing technology, and it is apparent for those common skilled in the art that the accompany drawings described as below are just some embodiments of the present invention and other accompany drawings can be acquired on the basis of those accompany drawings on the premise of not paying creative work.

FIG. 3 is a schematic diagram of distribution of inner compartments of the floating body according to the present invention; wherein

DETAILED DESCRIPTIONS OF THE PREFERRED EMBODIMENTS

Figure 1:
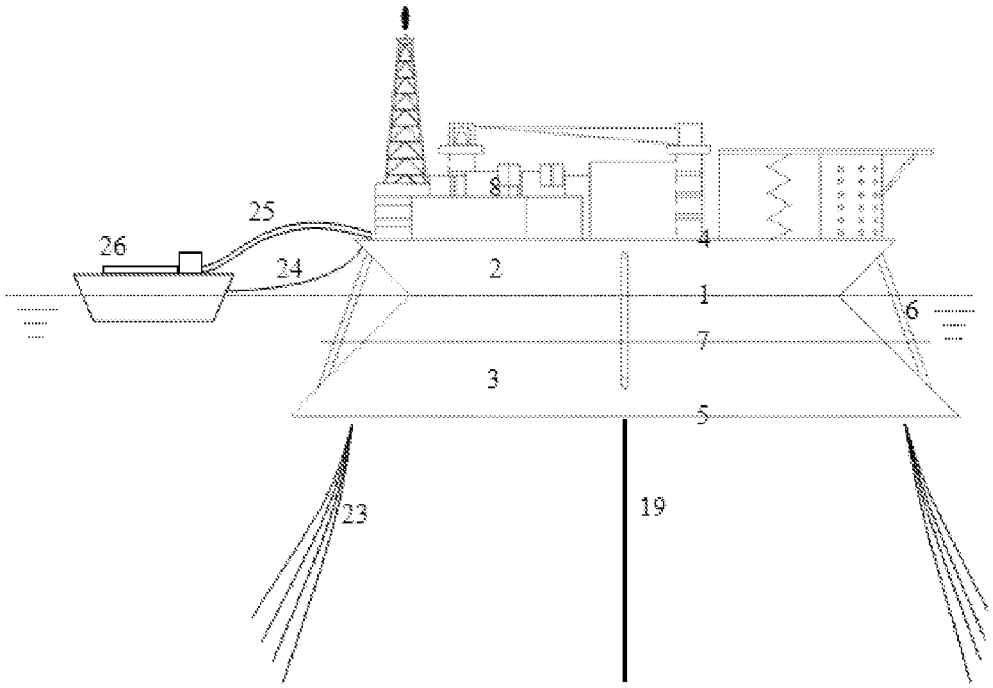
FIG. 1 is a schematic diagram of the butt joint octagonal frustum type FPSO system according to the present invention.
Figure 2:
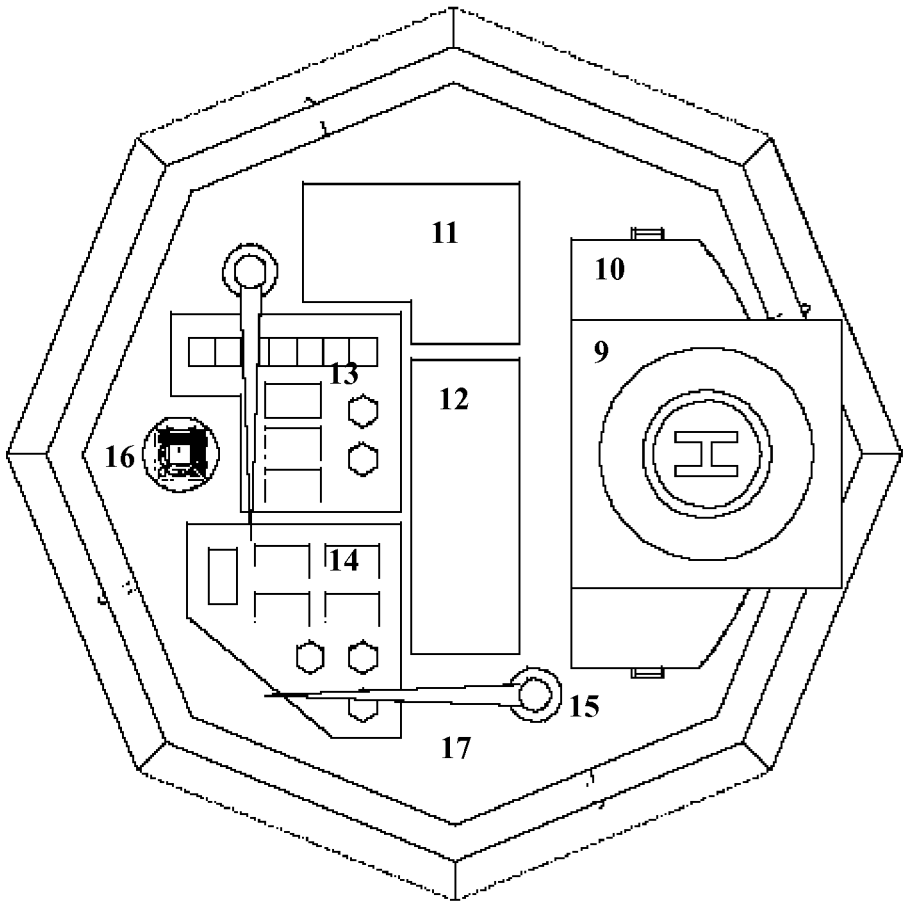
FIG. 2 is a schematic diagram of the production and life modules of the upper deck according to the present invention.
Figure 3A:
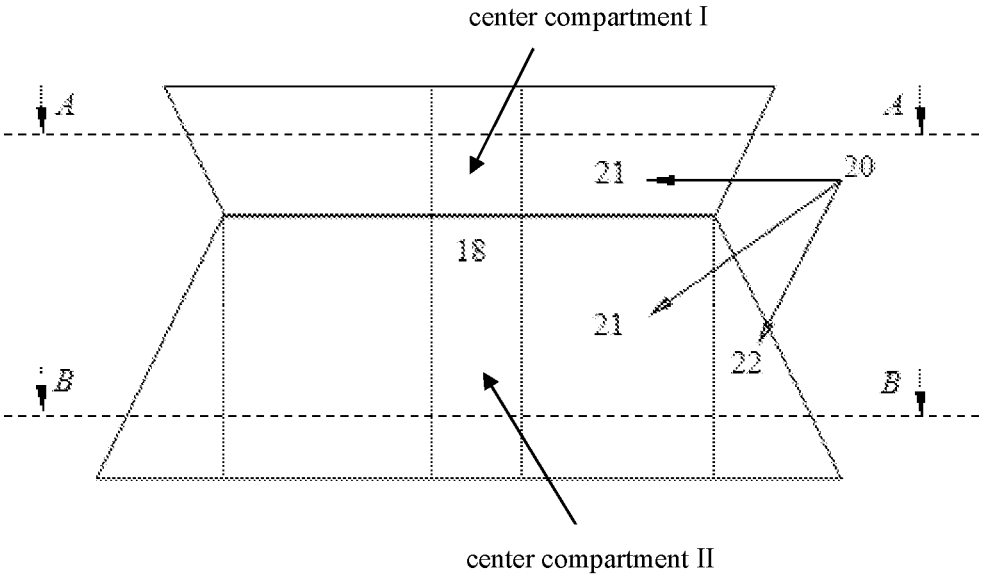
FIG. 3A is a side view of the floating body according to the present invention.
Figure 3B:
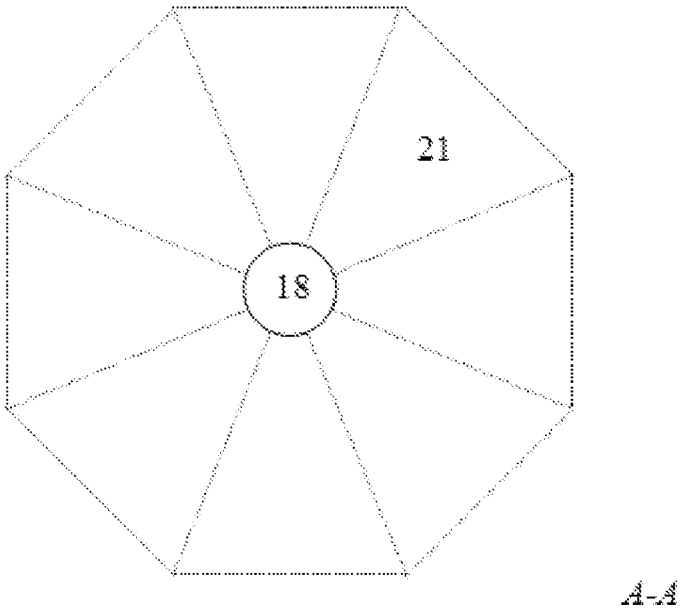
FIG. 3B is a schematic diagram of the cross section A-A.
Figure 3C:
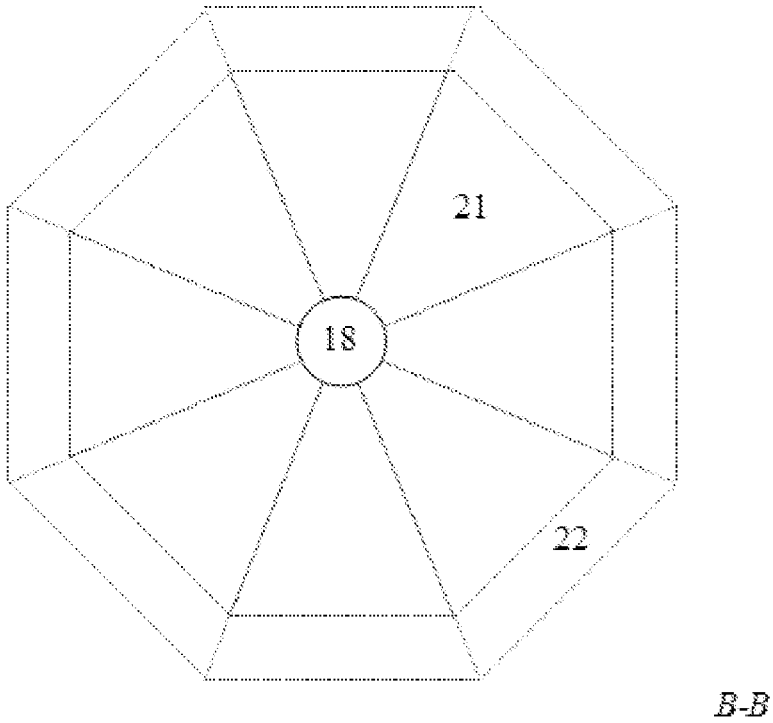
FIG. 3C is a schematic diagram of the cross section B-B.

The technical solution in the embodiments of the present invention is described clearly and completely in conjunction with the accompanying drawings in the embodiments of the present invention in order to make the objective, the technical solution and the advantages of the present invention clearer:

As shown in FIG. 1, the butt joint octagonal frustum type FPSO system mainly comprises two parts, namely an upper structural body 2 shaped as a regular octagonal frustum and an lower structural body 3 shaped as a regular octagonal frustum; under a combined state, the upper structural body 2 is of an inverted octagonal frustum, that is to say, the upper bottom area is larger than the lower bottom area; on the contrary, the lower structural body 3 is of an upright regular octagonal frustum, that is to say, the upper bottom area is smaller than the lower bottom area. The lower bottom having a relatively small area of the upper structural body 2 is butt jointed with the upper bottom having a relatively small area of the lower structural body 3 to each other to form a junction surface which is parallel to the deck and the lower bottom. When the structure is under water, the conjunction surface acts as a waterplane or full-load waterplane 1 of the structure main body.

Due to the existence of relatively small waterplane, externally-expanded and inclined underwater side surface and large-area bottom surface relative to the waterplane, the natural heaving period of the floating body is effectively controlled to be away from the spectrum high-energy band, and the damping and added mass of pitch/roll and heave movements of the floating structure in the wind wave frequency band may be increased. Said floating structure has better movement stability relative to the traditional floating structure.

In practical production process, it may be not limited to a generating and processing method in which the upper and lower structural bodies are separated, and the upper and lower structural bodies can also be integrally molded according to actual situations.

In order to further enhance the movement stability of the butt joint octagonal frustum type FPSO system in water, as a preferable embodiment, the outer surface of the lower structural body is equipped with an annular side plate 7 which is horizontally configured generally; at a service state, the annular side plate 7 is positioned under the water level, that is, parallel to other planes of said structure, and in the meantime, the pitch angle of the annular side plate 7 can be adjusted according to actual sea conditions of different sea areas. The annular side plate structurally has a function similar to a heave plate and a bilge keel on a ship and can restrict the movement response of the floating body at the low-frequency surge frequency band. The present invention has extremely good pitch/roll and heave movement resistance, relatively strong adaptive capacity to extreme sea environments and very high work effectiveness and safety in conjunction with the shape of the structure main body.

Furthermore, preferably, the present invention has a plurality of support pillars 6 arranged outside the structure main body in order to increase the self strength of the floating structure, and generally, the support pillars 6 are symmetrically arranged, that is to say, the support pillars 6 are symmetrically arranged relative to the central axis of the floating structure main body. Two ends of each support pillar 6 are fixedly connected with the upper structural body 2 and the lower structural body 3, respectively and the central axis of each support pillar 6 and the central axis of the structure are positioned on the same plane. Accordingly, the support pillars may play roles of enhancing the bearing capability of the deck and improving the bending strength of the floating body.

The shape and the fixing mode of the support pillars 6 are not limited to this and other installing and fixing modes can also be applied. As another preferable embodiment, the support pillars 6 are uniform in length, wherein the fixed ends, positioned on the upper structural body, of the support pillars 6 are positioned on the same plane, and the fixed ends, positioned on the lower structural body, of the support pillars 6 are positioned on the plane; the two adjacent support pillars 6 constitute an isosceles triangle.

The butt joint octagonal frustum type FPSO system is mainly manifested in shape of the hull and can be provided with multiple types of functional compartments internally so as to meet different requirements on different types of offshore operations. As a preferable embodiment, the upper structural body internally has a center compartment I which is identical in height with said upper structural body, and multiple watertight compartments 20 or multifunctional compartments 22 surrounding the center compartment are arranged around the center compartment I. Preferably, the multiple watertight compartments 20 are arranged axis-symmetrically. The watertight compartments 20 are fixedly connected with the inner wall of the hull of the upper structural body and the outer wall of the center compartment I, respectively; and these functional compartments provide support for the structure.

Further, owning to the special structure of the present invention, the area of the upper deck of the floating structure is larger than that of the traditional cylindrical FPSO, and a production area and a life area are configured on the upper deck of the structure in partitions so as to meet the requirements for fireproofing, anti-explosion, safety escape and the like. As a preferable embodiment:

A production module and a life module, which are independent of each other, are configured on the deck, wherein the production module is positioned on one side of the deck and comprises a life and office building and a helicopter deck positioned above the life and office building. A main generator module and a heat station module which have relatively high safety coefficients in the production module are arranged on a position close to the life module, an oil and gas processing module and a flare tower which have relatively low safety coefficient are configured on one side, back onto the life area, of the main generator module and the heat station module, and meanwhile, for consideration of convenience for firefighting, a water treatment module is arranged near the flare tower, which can provide a large amount of water for firefighting.

In the same way, the lower structural body internally has a center compartment II which is identical in height with said lower structural body, and multiple watertight compartments surrounding the center compartment II are arranged around the center compartment II, are fixedly connected with the inner wall of the hull of the lower structural body and the outer wall of the center compartment II respectively and provide support for the hull of the lower structural body.

Further, in order to be able to mount a drill bit, risers or other production operation equipment, preferably, the center compartment I intercommunicates with the center compartment II in the vertical direction to form a moonpool 18 penetrating through the whole structure so as to provide convenience for mounting related equipment. In the meantime, since the moonpool and seawater are communicated, the stability of the structure in water can be further enhanced. The moonpool can be internally equipped with different pipelines and risers while working, wherein the risers include risers 19 are of multiple types, such as flexible risers (FR), hybrid tower risers (HTR) and steel catenary risers (SCR).

Further, each watertight compartment 20 comprises inner compartments and outer compartments, wherein the inner compartments are positioned on the peripheries of the center compartments, and the outer compartments are positioned on the peripheries of the inner compartments and are connected with the inner compartments and the structure hull. Preferably, the inner compartments are closer to the center compartments or moonpool 18 and conveniently connected with various petroleum pipelines, thus the inner compartments generally serve as oil storage compartments. The outer compartments which serve as multifunctional compartments can be configured into an air compressor skid, a public air reservoir, an instrument air reservoir, life sewage treatment equipment, a fresh water tank, a fire-fighting pump room, an engine room, a heat transfer oil storage tank, a diesel oil transfer pump of a diesel tank, a seawater lifting pump, a seawater filter and the like as required.

Moreover, the present invention also has the following performance advantages:

An underwater part of the present invention adopts a lateral design having a certain externally-expanded tilt angle. On the basis of having enough oil reserve quantity and favorable seakeeping performance, the present invention, compared with SPAR and deep draught semi-submersible type structure, the present new type floating body has relatively small water draught, easy to maintain, migrate and tow, can be further used for shallow water works and has stronger applicability to applied sea areas.

The present invention has relatively small waterplane and relatively small vertical and horizontal characteristic lengths, thus being capable of reducing vertical and horizontal hogging or sagging bending load of the wave action on the structure. In addition, since the present invention has a hourglass-shaped structure small in the middle and large in two ends, the floating body has a relatively high middle section modulus in any direction, and therefore the structural strength is further increased, so that structure bending and fatigue stress can be positioned at a relatively low level.

The underwater part of the present invention adopts a lateral design having a certain externally-expanded tilt angle. The novel floating body, compared with a cylinder having same waterplane area and volume of displacement, has smaller underwater incident flow area. Furthermore, the externally-expanded side surface is beneficial to restricting generation of vortex-induced vibration. Therefore, under the same ocean current environment, the novel floating body will suffer relatively small flow load action.

The floating body of the present invention is shaped as central symmetry, so that the center compartments or the moonpool can be built in the center of the floating body very conveniently for laying pipelines directly leading to all liquid compartments, whereas no pipeline is needed any more in oil and water compartments, and thus the engineering design, construction and operation are greatly simplified and various raw materials, such as pipelines and cables can be saved. On the other hand, since the levels of similarity of various module structures of the novel floating body are high, it is very suitable to adopt a modularized construction technology, and thus the design and construction difficulties are reduced. Furthermore, the floating body can be segmented symmetrically according to the symmetry principle, the requirements of the main body on dock construction are reduced, and accordingly, a larger choice is provided for owners.

The present invention adopts a lateral design having a certain externally-expanded tilt angle, which can increase the volumetric static moment of immersed and emerged wedges when the floating body inclines. Therefore, under the condition of meeting the initial stability and along with the increase of tilt angle, the restoring torque of the floating body is increased fast according to the lateral shape with the accompanying of relatively large extreme restoring torque and vanishing angle of stability. Moreover, the pitch/roll damping and added mass of the floating body can be greatly increased with combination of inclined lateral design and the annular side plate structure, and thus the natural period can be prolonged and the movement amplitude can be reduced. Hence, the novel floating structure can provide enough big stability of tilt angle without generating violent rolling when encountering stormy waves and thus has stability suitable for deep sea environment. On the other hand, the waterplane size and the inertia moment of the underwater floating body continuously increase along with the decrease of draught, and stability loss caused by decrease of displacement and height of center of buoyancy can be well remedied, and therefore, the novel floating body can effectively promote stabilities under different load conditions, such as full load and ballast load and avoid the stability loss caused by heave resonance movement of the cylindrical FPSO or SPAR platform.

The present invention adopts a structure having double bottoms and double hull board sides. This structure can enhance the hybrid rigidity of a main deck and a central shaft of the novel floating body, which is favorable for longitudinal strength of the structure. Moreover, the internal spaces of the double bottoms and the double hull board sides can act as water ballast tanks and also prevent damage and oil spillage of the floating body while playing a ballast effect, thus ensuring the safety and environmental friendliness of the production operation.

The present invention adopts an appearance design of a single revolving body, which overcomes the defects caused by twin hull appearance that the draught is very sensitive to load capacity change, the surface area is too large and the structure is relatively heavy, so that the mass of the main body of the novel floating body is relatively low, the effective load rate is increased, and further, the amount of steel and the cost of the structure are decreased.

The part above water of the present invention adopts a lateral design having a certain externally-expanded tilt angle. This appearance design having certain flare can decrease the wave run-up height of the novel floating body on the premise of excellent pitch/sway and heave movement performances, thus being capable of reducing the phenomenon of green water on deck appropriately. Furthermore, compared with a cylinder having the same waterplane area and volume, the inverted octagonal-frustum-shaped floating body has relatively small windward area and relatively low stress point of action, and therefore, this novel floating body suffers relatively small wind load and wind heeling moment under the same sea wind conditions.

The present invention adopts a lateral design having a certain externally-expanded tilt angle. Therefore, when the sea ice acts on the side surface of the inclined floating body, traditional extrusion damage is changed into bending damage having relatively weak strength, and thus the ice load acting on the structure can be greatly decreased, and accordingly, the novel floating body has more excellent ice resistance and can be applicable to frozen sea areas.

Figure 4A:
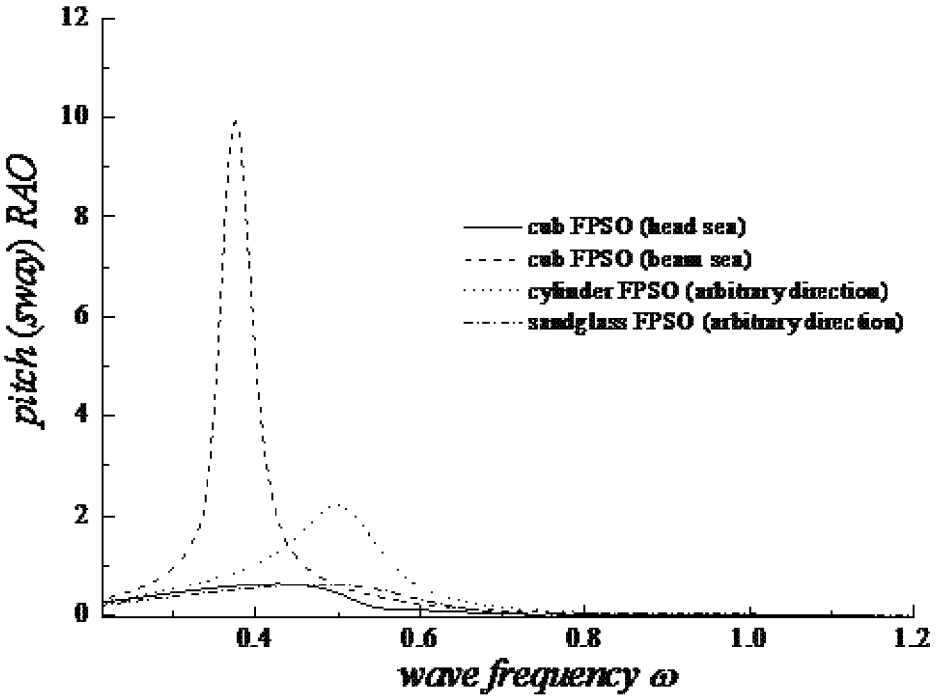
FIGS. 4A and 4B are comparative schematic diagrams of hydrodynamic performances of various types of FPSO; and In the figure: 1. full-load waterplane, 2. the upper structural body, 3. the lower structural body, 4. the upper deck, 5. the lower bottom, 6. the support pillars, 7. the annular side plate, 8. the production and life modules, 9. the helicopter deck, 10. the life and office building, 11. the main generator module, 12. the heat station module, 13. the water treatment module, 14. the oil and gas processing module, 15. the crane, 16. the flare tower, 17. the upper main deck, 18. the moonpool, 19. the risers, 20. the watertight compartments, 21. the oil storage compartment, 22. the multifunctional compartments, 23. the multi-point mooring system, 24. the mooring rope, 25. the external transport hose, 26. the shuttle tanker.
Figure 4B:
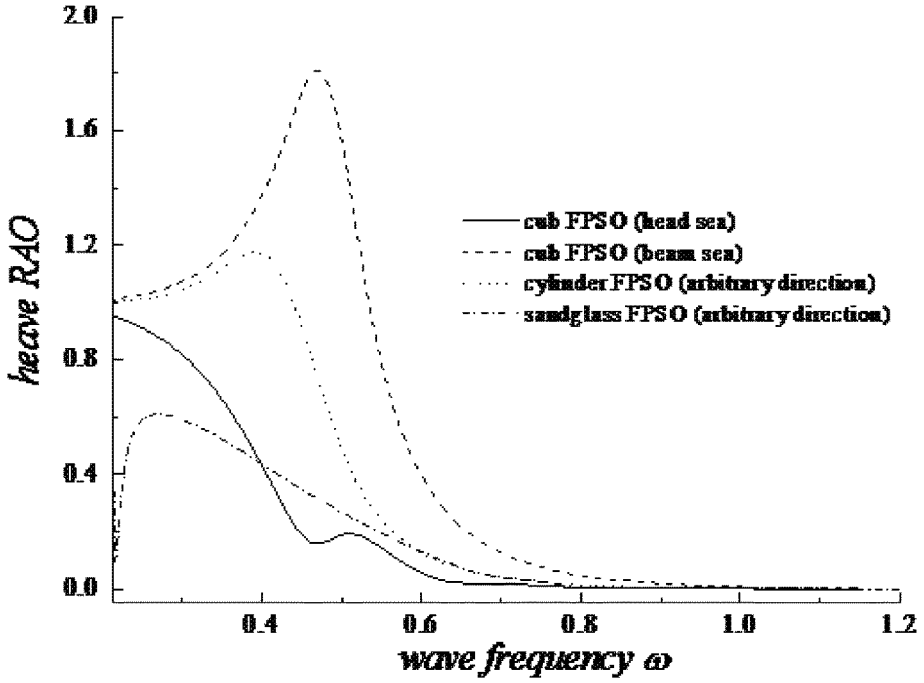

Here, in order to illustrate favorable movement performance advantage of a butt joint octagonal frustum type oceaneering floating workpiece as described in the present invention more intuitively, a traditional rectangular barge FPSO, a cylindrical drum FPSO and the butt joint octagonal frustum type FPSO (namely said butt joint octagonal frustum type oceaneering floating workpiece) having the same functions (load capacity, volume of the floating body and the area of the upper deck) are compared and analyzed, and now, high-frequency movement performances (pitch, roll and heave) of various FPSO, which are calculated according to a verified general potential flow boundary element theory at present are represented by FIG. 4A and FIG. 4B, with a major focus on wind wave frequency band 0.209-6.28 (1-30 s) having relatively high energy.

As can be seen from the figures, compared with a barge-type FPSO, the novel FPSO has greatly promoted heave and rolling movement performances when encountering the waves transversely, which are basically similar to the heave and pitch performances when encountering waves longitudinally. Furthermore, the pitch/roll and heave movement performances of the novel FPSO are greatly superior to those of the cylindrical drum FPSO. Therefore, it is indicated that the water dynamic performance of FPSO can be greatly improved due to the unique appearance design of the present invention.

In FIG. 4A and FIG. 4B, cub represents a rectangular barge FPSO model (head sea represents longitudinal motion in heading sea and beam sea represents transverse motion in heading sea), cylinder represents a cylindrical drum FPSO model, sandglass FPSO represents the butt joint octagonal frustum type oceaneering floating structure as described in the present invention. Besides, six degrees of freedom movement are surge, sway, heave, pitch, roll and yaw.

As stated above, the preferable embodiments abovementioned of the present invention are described, however, the present invention is not limited to these embodiments specifically disclosed, equivalent replacement or change, made by any technical personnel skilled in the art disclosed in the present invention in accordance to the technical solution and inventive concept of the present invention, should fall into the protection scope of the present invention.

The invention claimed is:

1. A butt joint octagonal frustum type floating production storage and offloading system, comprising:

an upper structural body in a regular octagonal frustum shape;

a lower structural body in a regular octagonal frustum shape, wherein the upper structural body and the lower structural body are connected through their respective smaller bases at a junction plane to form a floating structure, and an axis of the upper structural body and an axis of the lower structural body are aligned, wherein the upper structural body comprises an upper hull, a center compartment I disposed inside the upper hull that has a same height as that of said upper structural body, and a plurality of watertight compartments disposed between the upper hull and the center compartment I, wherein the lower structural body comprises a lower hull, a center compartment II that has a same height as that of said lower structural body, and a plurality of watertight compartments disposed between the lower hull and the center compartment II, wherein a larger base of the upper structural body serves as a deck and a larger base of the lower structure body serves as a bottom of the floating structure, wherein the center compartment I and the center compartment II are hollow and are connected to form a straight shaft extending vertically through the floating structure from the larger base of the upper structural body to the larger base of the lower structural body, and wherein floating production storage and offloading system further comprises a plurality of support pillars disposed about an exterior surface of the floating structure, wherein an upper end of a support pillar is fixedly attached to the upper structural body at an upper attach point and a lower end of the support pillar is fixedly attached to the lower structural body at a lower attach point, and each individual support pillar and the axis of the floating structure are located in a same plane.

2. The butt joint octagonal frustum type floating production storage and offloading system according to claim 1, further comprising: an annular side plate attached to an outer surface of said lower structural body.

3. The butt joint octagonal frustum type floating production storage and offloading system according to claim 1, wherein all of the plurality of support pillars are of a same length, and all upper attach points are located in an upper plane and all lower attach points are located in a lower plane, wherein two adjacent support pillars form two sides in an imaginary isosceles triangle.

4. The butt joint octagonal frustum type floating production storage and offloading system according to claim 1, wherein the floating structure has a double-hull structure.

5. The butt joint octagonal frustum type floating production storage and offloading system according to claim 1, further comprising: a production module and a life module disposed on the deck, wherein the life module is disposed on one side of the deck and comprises a life and office building and a helicopter deck positioned above the life and office building, the production module comprises a main generator module and a heat station module which are located in a center portion of the deck, a water treatment module and an oil and gas processing module disposed on another side of the deck away from the life module, and a flare tower disposed between the water treatment module and the oil and gas processing module, and a crane disposed by the life module.

6. The butt joint octagonal frustum type floating production storage and offloading system according to claim 1, further comprising a multi-point mooring system outside the floating structure.

7. The butt joint octagonal frustum type floating production storage and offloading system according to claim 1, wherein one or more of the watertight compartments is an inner compartment adjacent to the center compartment I or the center compartment II and serves as an oil storage compartment, or an outer compartment disposed between the inner compartment and the upper or lower hull.

* * * * *